US006219979B1

(12) United States Patent
Lohr

(10) Patent No.: US 6,219,979 B1
(45) **Date of Patent: *Apr. 24, 2001**

(54) THRESHOLD ASSEMBLY

(76) Inventor: Helmut Lohr, 20436-I22B Ave., Maple Ridge B.C. (CA), V2X IB6

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/256,415

(22) Filed: Feb. 24, 1999

(30) Foreign Application Priority Data

Jan. 7, 1999 (CA) ..... 2257475

(51) Int. Cl.[7] ..... E06B 1/70

(52) U.S. Cl. ..... 52/211; 52/204.1; 52/210; 52/62; 52/204.55; 52/656.4; 52/209; 49/467; 49/471

(58) Field of Search ..... 52/204.1, 209, 52/210, 211, 97, 62, 204.55, 656.4; 49/467, 469, 471, 476.1, 499.1

(56) References Cited

U.S. PATENT DOCUMENTS

| | | | | |
|---|---|---|---|---|
| 258,486 | * | 5/1882 | Singer | 49/471 |
| 448,501 | * | 3/1891 | Bussert | 49/471 |
| 665,958 | * | 1/1901 | Dugan | 52/97 |
| 1,287,673 | * | 12/1918 | Gogay | 52/211 |
| 1,677,130 | * | 7/1928 | Cherry | 52/209 |
| 1,904,404 | * | 4/1933 | Burk | 52/62 |
| 2,043,049 | * | 6/1936 | Ludden | 52/62 |
| 2,570,336 | * | 10/1951 | Fouts | 52/209 |
| 2,648,107 | * | 8/1953 | Bates, Jr. | 52/97 |
| 2,996,766 | * | 8/1961 | Barnes | 52/211 X |
| 3,014,253 | | 12/1961 | Manville . | |
| 3,261,130 | | 7/1966 | Lawson . | |
| 3,436,886 | * | 4/1969 | Nowak et al. | 52/211 X |
| 3,778,931 | * | 12/1973 | Donaldson | 49/469 X |
| 4,228,630 | * | 10/1980 | Englert et al. | 52/211 X |
| 4,555,882 | * | 12/1985 | Moffitt et al. | 52/209 |
| 4,905,414 | * | 3/1990 | Campbell | 49/469 |
| 5,465,540 | * | 11/1995 | Biernazki | 52/210 X |
| 5,542,217 | * | 8/1996 | Larivee, Jr. | 49/471 |

FOREIGN PATENT DOCUMENTS

| | | | | |
|---|---|---|---|---|
| 620509 | * | 5/1961 | (CA) | 52/211 |
| 1052184 | | 4/1979 | (CA) . | |
| 297734 | | 8/1987 | (CA) . | |
| 2115138 | * | 10/1972 | (DE) | 49/467 |
| WO98/32942 | | 6/1998 | (WO) . | |

* cited by examiner

*Primary Examiner*—Laura A. Callo
(74) *Attorney, Agent, or Firm*—Frederick Kaufman

(57) ABSTRACT

A threshold assembly comprising a sill and a pair of lateral brackets which are upwardly extending and oppositely facing. Each lateral bracket is attached at the lower, outside part of each jamb of a door frame.

2 Claims, 3 Drawing Sheets

THRESHOLD ASSEMBLY

BACKGROUND OF THE INVENTION

1. Field of the Invention

The present invention relates generally to the field of thresholds. More specifically, it relates to a threshold assembly which substantially contributes to sealing capacity of the doors against water attempting to infiltrate from the outside area into the building.

2. Description of the Prior Art

The use of doors in conjunction with threshold assemblies is common in today's construction. External doors are usually mounted together with a threshold assembly, above which the door is located in its closed position. Basically, a threshold assembly comprises a sill facing outwardly from the building and a threshold facing inwardly towards the building.

It is known, that one of the major problems in house construction is that of preventing the leakage of water from the exterior of the house. Among other functions, thresholds accomplish the important function of barrier to moisture and water infiltration.

As it is known, threshold assemblies are attached to the jambs of door frames. During manufacture, transport, assembly with the door frame in buildings and use, a gap between each jamb and the sill appears. Moreover, since the sill is formed from aluminum and the threshold is formed from a plastic, such as polyvinyl chloride or any of a plurality of relatively rigid plastics, commonly known under the name "vinyl" their dilation and contraction characteristics are very different, and a gap due to the climatic changes appears. This gap enlarges the gap mentioned above.

From the prior art there are known sealing attachments which are joined to the doors to eliminate or at least substantially reduce only the passage of water beneath 10 the lower edge of the door frame.

Several U.S. and Canadian Patents have addressed the issue of sealing attachments to the doors.

The following disclosures relate to various types of known attachments:

Sowers (U.S. Pat. No. 5,642,588, issued Jul. 1, 1997); Biebuyck (U.S. Pat. No. 5,469,665, issued Nov. 28, 1995); Fulford (U.S. Pat. No. 5,361,552. issued Nov. 8, 1994); Biebuyck (U.S. Pat. No. 5,319,882, issued Jun. 14, 1994); Geoffrey (U.S. Pat. No. 5,230,181, issued Jul. 27, 1993); Woodruff (U.S. Pat. No. 5,214,880, issued Jun. 1, 1993); Knapp (U.S. Pat. No. 5,168,669, issued Dec. 8, 1992); Burnett (U.S. Pat. No. 5,150,544, issued Sep. 29, 1992); Shield (U.S. Pat. No. 5,022,206, issued Jun. 11, 1991); Heikkinen (U.S. Pat. No. 4,807,396, issued Feb. 28, 1989); and Opdyke (Canadian Appl. No. 2,203,482, publ. Oct. 26, 1997); Wilson (Canadian Appl. No. 2,132,741, publ. Sep. 30, 1993); Grimsdale (Canadian Pat. No. 2,072,909, issued Jul. 18, 1995); and Wicks (Canadian Pat. No. 2,034,320, issued Nov. 22, 1994).

The applicant believes that the cited disclosures, taken alone or in combination, neither anticipate or render obvious the present invention. The forgoing citations do not constitute an admission that such disclosures are relevant or material to the claims. Rather the disclosures are related to the field of the invention and are cited as constituting the closest art of which the applicant is aware.

SUMMARY OF THE INVENTION

After substantial experimentation and testing, the inventor has reached the conclusion, that by using a threshold assembly for attachment to the lower exterior side of each of the two opposite jambs of a door frame, he eliminates or at least alleviates the leakage due to the disclosed gap. Thus, broadly described, the threshold assembly according to this invention comprises the combination of a sill with a pair of upwardly extending and oppositely facing lateral brackets. One of the lateral brackets of the pair is positioned perpendicularly at one end of the sill, to which it is firmly joined. The other lateral bracket is positioned and joined in the same manner, at the opposite end of the sill. Each of the lateral brackets is provided with holes for fastening means for attachment to the mentioned jambs. The sill and the lateral brackets form an unitary and continuous structure. In one aspect of the invention, each of said lateral brackets extends laterally beyond the sill, so that its length is commensurate with the width of the jamb. The holes are positioned at regular intervals to allow attachment to said jamb, on its whole width.

In another aspect of the invention, each of said lateral brackets is joined from its inside to the sill of their line of contact, by welding.

BRIEF DESCRIPTION OF THE DRAWING

The features and use of the present invention will become understood by way of the following detailed description of the preferred embodiment with reference to the appended drawing in which.

DESCRIPTION OF THE PREFERRED EMBODIMENT

Figure 1:
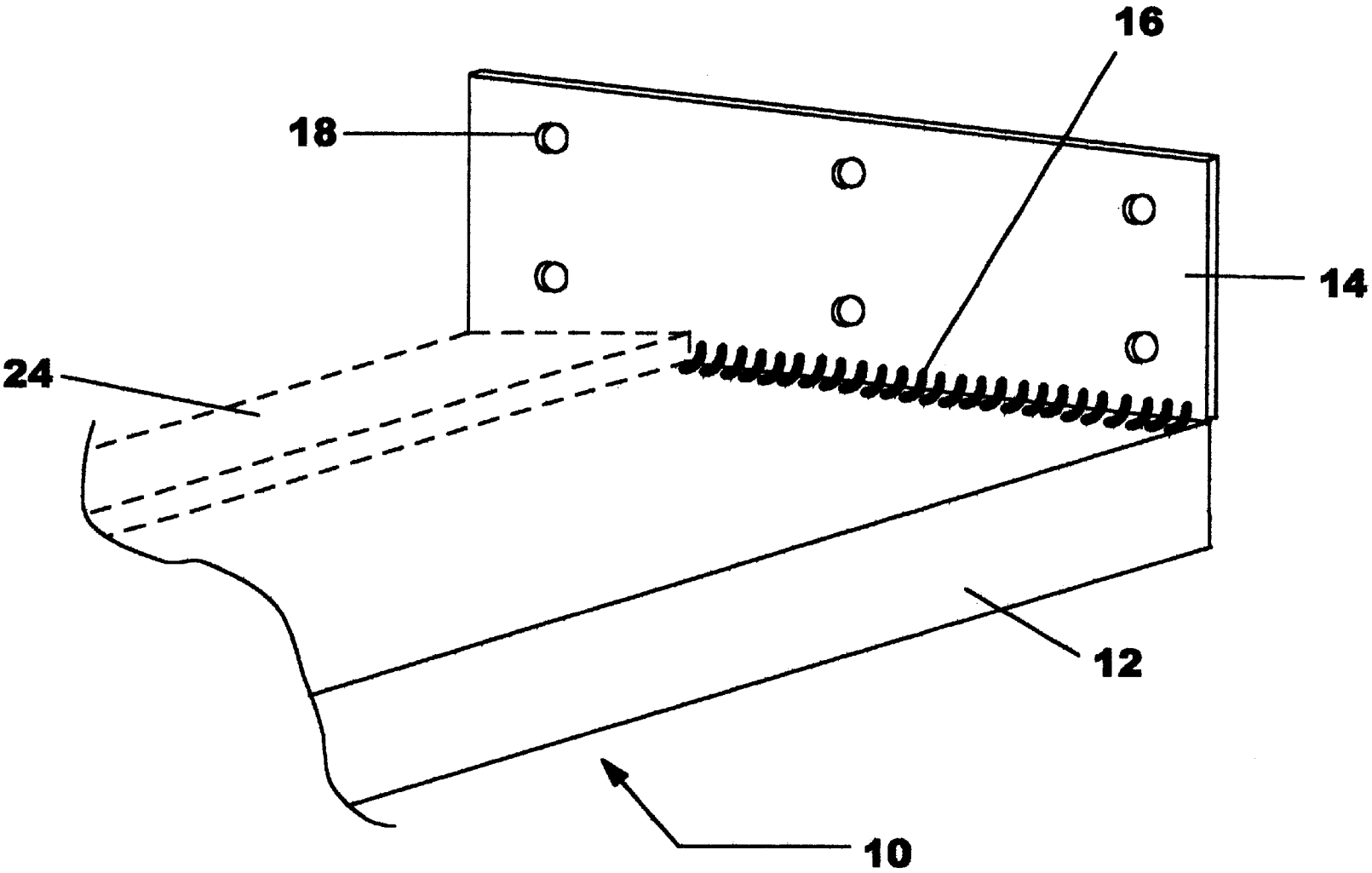
FIG. 1 is a perspective partial view illustrating the sill and a lateral bracket.
Figure 2:
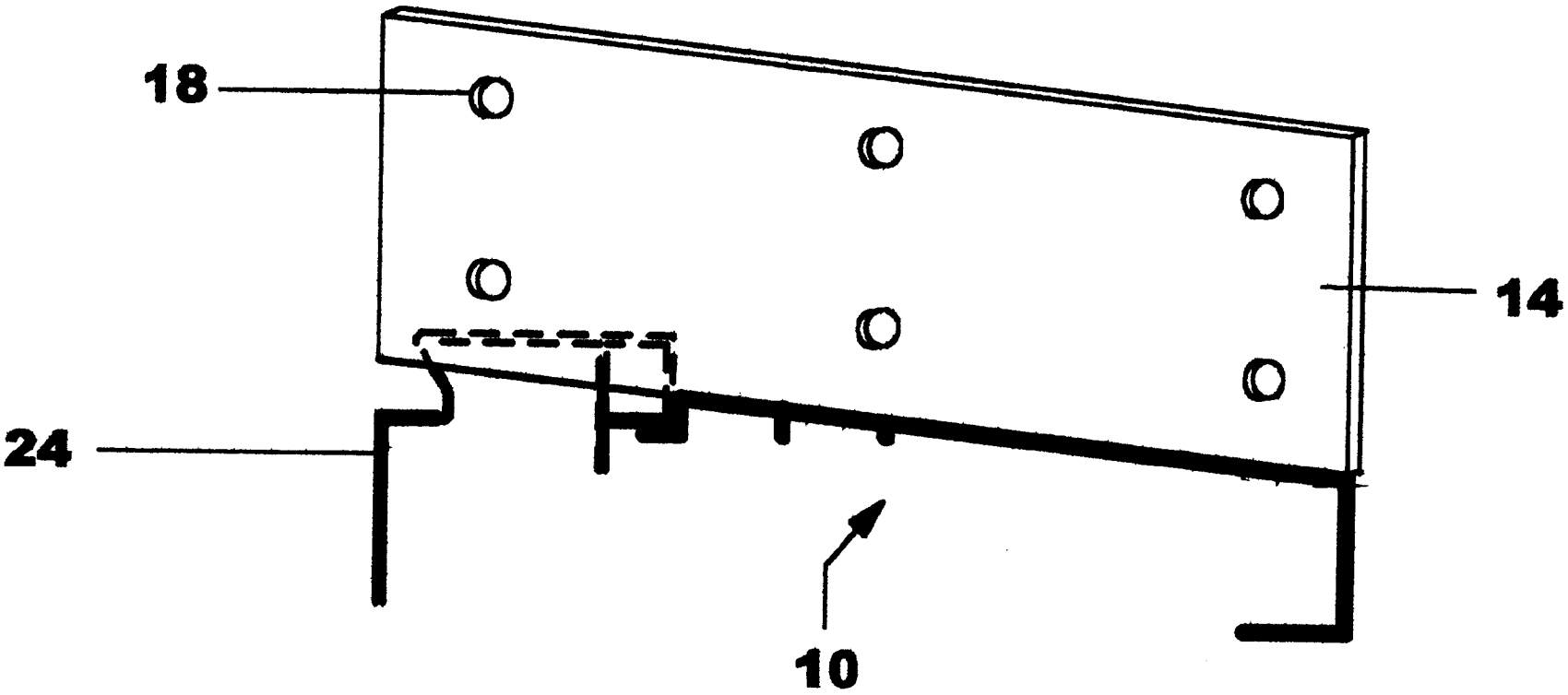
FIG. 2 is a perspective view of a lateral bracket together with a sill and threshold.
Figure 3:
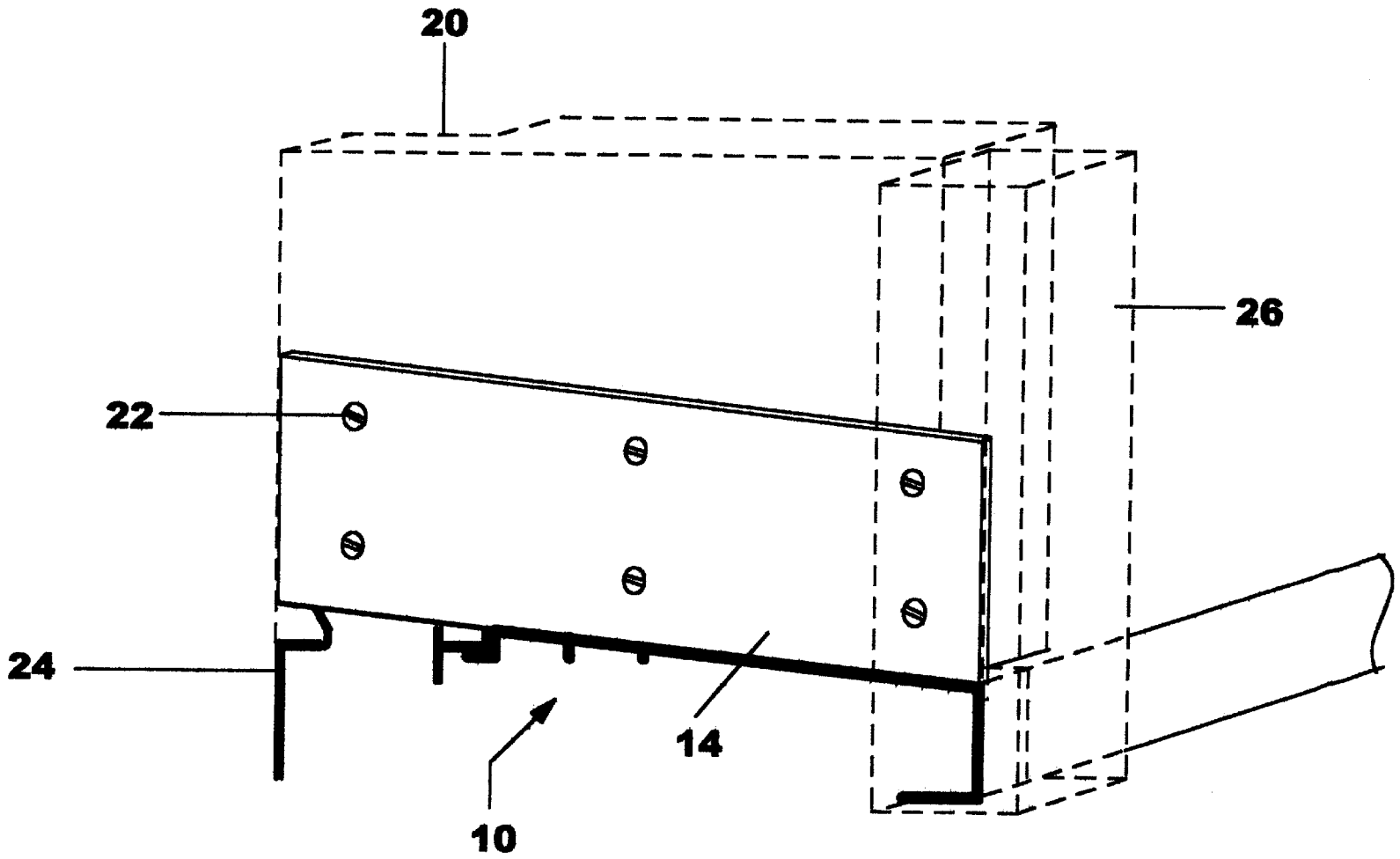
FIG. 3 is a perspective partial view of the threshold assembly attached to a jamb and a brickmould.

Reference is now made to the drawings wherein like features are designated by the same numerals.

Referring now to the drawings, the number 10 denotes the threshold assembly according to the present invention. Threshold assembly 10 comprises a sill 12 provided with a pair of upwardly extending and oppositely facing lateral brackets 14.

Each lateral bracket 14 is positioned perpendicularly at one end of sill 12, to which it is joined from the interior, at the line of contact sill-lateral bracket, by a welding seam 16. Thus, an unitary and continuous structure is formed. Each lateral bracket 14 is provided with six holes 18 positioned at regular intervals. Each lateral bracket 14 extends laterally beyond sill 12. Its length is commensurate with the width of a door jamb 20. Screws 22 are used to attach lateral bracket 14 to jambs 20 on the whole width of each jamb 20.

As can be seen, threshold assembly 10 as described above, 10 confers a structural rigidity, which before could not be attained by the use of a conventional connecting wood element (not shown), placed under sill 12 and a threshold 24. A brickmould 26 is penetrated by lateral bracket 14 and by jamb 20 for attachment to the building.

What is claimed is:

1. In a door frame comprising two jambs and a threshold extending between and below said jambs, the improvement wherein the threshold comprises a unitary assembly of a sill and a pair of upwardly extending opposed brackets attached to the sill at the ends thereof by welded seams, said brackets being disposed outside of said jambs and engaging the outer faces of the jambs, said brackets comprising holes and being connected to the jambs by a plurality of screws passing through said holes and into said jambs.

2. The door frame of claim 1, wherein each of said brackets is as wide as its respective jamb.

* * * * *